US005497701A

United States Patent [19]

Uland

[11] Patent Number: 5,497,701

[45] **Date of Patent: * Mar. 12, 1996**

[54] METHOD AND APPARATUS FOR PRINTING LINERLESS MEDIA HAVING AN ADHESIVE BACKING

[75] Inventor: David M. Uland, Mecklenburg County, N.C.

[73] Assignee: DataSouth Computer Corporation, Charlotte, N.C.

[ * ] Notice: The portion of the term of this patent subsequent to Jan. 30, 2013, has been disclaimed.

[21] Appl. No.: 243,198

[22] Filed: May 16, 1994

[51] Int. Cl.[6] ..... B41F 1/08

[52] U.S. Cl. ..... 101/288; 400/88

[58] Field of Search ..... 101/288, 228, 101/92; 400/88; 156/564, 566, 567

[56] References Cited

U.S. PATENT DOCUMENTS

| | | | |
|---|---|---|---|
| 2,326,436 | 8/1943 | Caldwell . | |
| 3,284,270 | 11/1966 | Noll et al. . | |
| 4,073,234 | 2/1978 | Sato . | |
| 4,384,525 | 5/1983 | Sato et al. . | |
| 4,826,558 | 5/1989 | Wada et al. | 101/288 |
| 5,069,564 | 12/1991 | Kako et al. . | |
| 5,083,979 | 1/1992 | Burt | 462/3 |
| 5,111,216 | 5/1992 | Richardson et al. | 101/288 |
| 5,188,029 | 2/1993 | Suzimoto et al. | 101/288 |
| 5,190,612 | 3/1993 | Orlandi . | |
| 5,192,392 | 3/1993 | Peterson et al. | 156/564 |
| 5,267,800 | 12/1993 | Petteriut et al. | 400/88 |
| 5,295,753 | 3/1994 | Godo et al. | 400/612 |

*Primary Examiner*—Ren Yan

*Attorney, Agent, or Firm*—Bell, Seltzer, Park & Gibson

[57] ABSTRACT

The method and apparatus for printing linerless media having an adhesive backing, such as a label strip, includes a platen roller rotatably mounted to a support frame for supporting and advancing the label strip and a pick for stripping or separating the printed label strip from the platen roller. Thus, a label strip may be fed from a wound roll between the platen roller and an aligned print head such that predetermined indicia are imprinted thereon. Upon further rotation of the platen roller, the leading edge of the label strip engages the pick which acts to release any appreciable adherence between the adhesive backing of the label strip and the platen roller, and such that the printed labels may extend from and be readily withdrawn from the printing apparatus.

25 Claims, 1 Drawing Sheet

METHOD AND APPARATUS FOR PRINTING LINERLESS MEDIA HAVING AN ADHESIVE BACKING

FIELD OF THE INVENTION

The present invention relates to printing devices and, more particularly, to devices for printing linerless media having an adhesive backing.

BACKGROUND OF THE INVENTION

Numerous labels and forms are printed each day for a variety of purposes. The printed labels may be attached to envelopes or other packages to indicate the source or destination of the envelope or package as well as any other handling information related to the particular package. For example, the U.S. Postal Service, Federal Express and other delivery services prepare individual labels for each letter or package to be delivered which indicate the addresses of both the source and the recipient, a tracking number and other relevant shipping information. Printed labels may also be applied to boxes, crates or other containers for purposes of inventory control and tracking. Such labels generally identify the type and quantity of goods in the container as well as the location of the container.

In order to print the large number of labels required, devices for rapidly printing large numbers of labels have been developed. These printing devices generally draw a continuous strip of labels from a wound roll and feed the labels past a print head such that predetermined information may be imprinted upon the individual labels. The operator may thereafter remove the printed labels and apply them to the corresponding packages.

Such printing devices include both stationary printing devices which are generally relatively large and portable printing devices which are relatively small so as to be carried by an operator in the field or through a warehouse. Such portable printers include not only the print head and means for entering data, such as a keypad, but also a wound roll of labels and the feed mechanism for drawing labels from the wound roll. Thus, labels may be printed on demand and applied to packages or containers in the field without the operator having to return to a stationary printing device in order to print the desired labels. For example, after counting the number of items in a particular container, an operator of a portable printing device may enter data representative of the type, quantity and location of the items, such as via a keypad, into the portable printer, print a label displaying such data and apply the label to the container.

The information to be imprinted on the labels is provided to the printing device from any one of several sources, including manual entry of the data via a keypad or downloading of data from a control computer. The information, regardless of its source, is imprinted upon the labels by a variety of methods including serial dot matrix printing, thermal printing, laser printing, impact matrix printing, ink jet printing, impact full form printing or other electrographic printing methods.

To further facilitate the rapid printing and processing of labels, labels have been specifically developed to be printed by such label printing devices. These labels, which are generally supplied in a wound roll, typically have an adhesive backing and are releasably supported by a carrier web or liner. In particular, a layer of a release agent, such as silicone, is generally disposed between the adhesive backing and the carrier web to permit removal of the labels from the carrier web.

In operation, the wound roll of labels and the supporting carrier web are rotatably supported by the printing device. The label strip is drawn from the roll and sequentially fed past a print head to imprint the desired information. The label strip is drawn from the wound roll and fed past the print head by a feed mechanism, such as one or more aligned rollers. Once printed, the labels are removed from the carrier web, such as by passing the label strip about a roller having a relatively small diameter, so as to permit application of the imprinted labels to a package. With respect to stationary printing devices, the remaining carrier web may thereafter be wound upon a take-up reel for subsequent disposal.

The carrier web remaining once the labels have been printed and removed is not reused, but is scrap which must be discarded. Even the disposal of the scrap carrier web is problematic, however, since the carrier web contains silicone which requires a relatively long time to degrade. Further, it is estimated that the cost of the carrier web amounts to 20% to 30% of the original cost of the wound roll of labels, thus, significantly increasing the material cost of the labels.

In addition, the carrier web contributes substantially to the overall size of the wound roll of labels. Since portable printing devices are relatively compact and may accordingly only accommodate a wound roll of labels of a predetermined size, the carrier web limits the number of labels which may be included within a portable printing device at any one time. Furthermore, the disposal of carrier web remaining after the labels have been removed is an even greater problem with respect to portable printing devices since such portable printers do not generally include a take-up reel for storing the remaining carrier web for subsequent disposal. Instead, the remaining carrier web must typically be periodically separated from the remainder of the wound roll of labels and disposed of or otherwise stored by the operator to prevent excessive amounts of the scrap carrier web from extending from and accumulating adjacent to the portable printer.

Accordingly, linerless labels have been developed which do not include a supporting carrier web. These labels have a primary substrate which is coated with a layer of adhesive on one side. Further, if these labels are formed in a strip which is to be wound in a roll, a layer of a release agent, such as silicone, is applied to a second side of the primary substrate, opposite the adhesive layer, so as to permit wound roll of labels to be unwound during printing.

However, conventional label printing machines, including conventional portable printing devices, are not adapted to process labels or strips of labels which are not supported by a carrier web. Correspondingly, the adhesive backed labels adhere to the feed mechanism of the printing device. Consequently, the printed labels may not be readily withdrawn from the printing device.

An apparatus for printing a linerless label strip having an adhesive backing which is not supported by a carrier web is disclosed in copending U.S. patent application Ser. No. 08/180,050 (hereinafter the "'050 application") to David M. Uland filed on Jan. 11, 1994 and assigned to the assignee of the present application, the contents of which are incorporated herein by reference. The printing apparatus of the '050 application includes an endless belt for transporting the label strip between a print head and an underlying platen and for permitting withdrawal of the label strip from the printing apparatus after the label strip has been imprinted. While the printing apparatus of the '050 application represents a great advance in the art of printing linerless media, the printing apparatus of the '050 application does require a rotating endless belt for transporting the label strip.

SUMMARY OF THE INVENTION

It is therefore an object of the invention to provide an improved method and apparatus for printing a strip of labels.

It is another object of the invention to provide an improved method and apparatus for printing linerless media having an adhesive backing.

It is a further object of the invention to provide an improved method and apparatus for printing a strip of labels which includes a rotating platen roller for supporting the label strip and an adjacent pick for stripping the labels from the platen roller following the printing of indicia on one side thereof.

These and other objects are provided, according to the invention, by a printing apparatus which includes a platen roller, rotatably mounted to a support frame, which supports and advances an adhesive backed label strip past a print head, and a pick, mounted downstream of the print head and immediately adjacent the platen roller, for stripping a leading edge portion of the label strip from the platen roller following the printing of indicia on one side of the label strip. Thus, a linerless label strip consisting of a primary substrate which is coated on one side with a layer of adhesive, but which is not supported by a carrier web, may be printed by and readily withdrawn from the printing apparatus of the present invention.

The printing apparatus of the present invention also includes means, including the print head, for printing indicia on one side of the label strip. In particular, the print head is positioned in alignment with the platen roller such that the label strip extends between the platen roller and the print head. The printing apparatus also includes means for rotating the platen roller such that the label strip is thereby advanced between the platen roller and the print head. In addition, the printing apparatus includes a holder mounted to the support frame for rotatably supporting a wound roll of the label strip.

The pick of the printing apparatus of the present invention preferably includes a first edge extending parallel to the axis of the platen roller. The first edge is positioned immediately adjacent to, and in some embodiments, in contact with, the peripheral surface of the platen roller at a location downstream of the print head. In one embodiment, the first edge is positioned about 90° about the arc of the peripheral surface of the platen roller from the print head.

The pick also preferably includes a pick surface extending outwardly from the first edge in a direction away from the platen roller. The pick surface preferably extends outwardly from the first edge at an angle of about 30° with respect to a radial line of the platen roller which passes through the first edge. The pick surface may include a plurality of grooves therein, which extend in a direction away from the platen roller and reduce the surface area of the pick surface which contacts the advancing label strip.

The printing apparatus preferably also includes a tear bar or cutter positioned downstream of the pick, and above the pick, for separating individual labels from the label strip after indicia has been imprinted thereon. In addition, the printing apparatus may include a protective case in which the support frame, holder, platen roller, printing means, rotating means and pick are disposed. The protective case preferably defines a slot through which the printed labels may be withdrawn. Further, the protective case may include a lid portion and a hingedly connected base portion which are adapted to be opened to expose the holder and facilitate the loading of the wound roll of labels thereon. In one embodiment, the protective case is relatively small such that the printing apparatus is portable and may be readily carried by an operator in the field.

The platen roller may include an outer peripheral layer of resilient material. Consequently, force exerted by the print head against the underlying platen roller compresses a portion of the outer layer of the platen roller and forms a relatively flat printing surface on the portion of the platen roller contacting the print head.

In addition, the platen roller is preferably comprised of a silicone material which does not appreciably adhere to the adhesive backing of the label strip. Likewise, the pick is preferably comprised of a plastic material which does not appreciably adhere to the adhesive backing of the label strip.

Accordingly, a strip of linerless labels having an adhesive backing which is not supported by a carrier web may be fed through the printing apparatus of the present invention and indicia may be imprinted thereon. Further, the printing apparatus of the present invention facilitates the stripping or separation of the adhesive backed labels from the rotating platen roll such that the printed labels may be readily withdrawn from the printing apparatus and applied to the appropriate package or container.

The foregoing and other aspects, advantages and features of the invention, and the manner in which the same are accomplished, will become more readily apparent upon consideration of the following detailed description of the invention taken in conjunction with the accompanying drawings, which illustrate preferred and exemplary embodiments, and wherein:

DETAILED DESCRIPTION OF THE PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiment set forth herein; rather, this embodiment is provided so that this disclosure will be thorough and complete and will fully convey the scope of the invention to those skilled in the art. Like numbers refer to like elements throughout.

Figure 1:
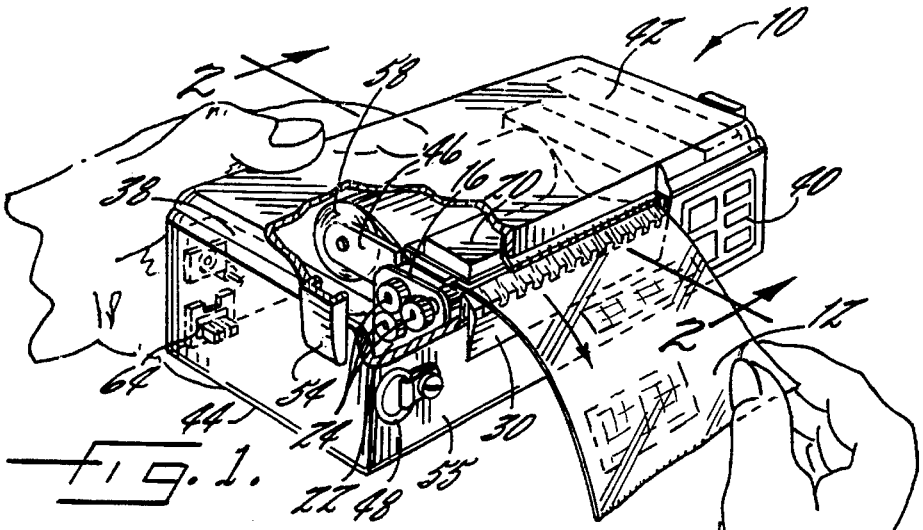
FIG. 1 is a perspective view of a printing apparatus according to the present invention which is partially cutaway to illustrate the internal components thereof.
Figure 2:
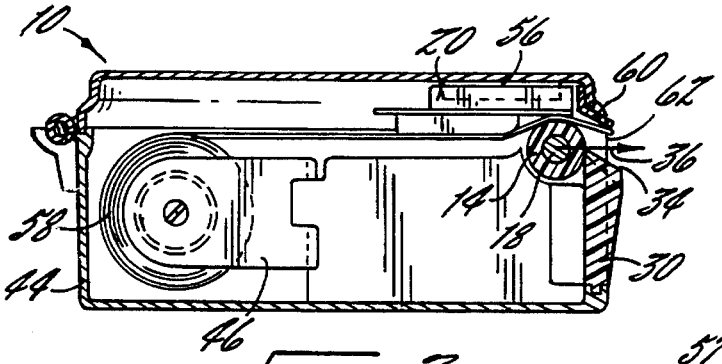
FIG. 2 is a lateral cross-sectional view of the printing apparatus taken along line 2—2 of FIG. 1.

Referring now to FIGS. 1 and 2, a printing apparatus 10 according to one embodiment of the present invention is illustrated. The printing apparatus 10 is adapted to print indicia on one side of a strip of adhesive backed labels 12. The printing apparatus 10 includes a platen roller 14 which is rotatably mounted to a support frame 16 and which defines an axis 18 extending therethrough. As illustrated, the platen roller 14 receives and supports the label strip such that the adhesive backed side of the labels 12 directly contacts the platen roller.

The printing apparatus 10 also includes means for printing indicia on one side of the label strip 12. The printing means includes a print head 20 positioned in alignment with and vertically above the platen roller 14 such that the label strip 12 extends horizontally between the platen roller and the print head. The print head 20 may be adapted to print labels 12 according to any of the known methods of printing including serial dot matrix, direct thermal, thermal transfer, laser, line matrix ink jet or impact full form printing as well as other electrographic printing methods. In the embodiment illustrated, the print head 20 is adapted to provide direct thermal printing as is known to those skilled in the art. Thus, in this embodiment, the label strip 12 is thermally sensitive such that appropriate indicia is imprinted thereon by the print head 20.

The printing apparatus 10 also includes means for rotating the platen roller 14 such that the label strip 12 is thereby advanced between the platen roller and the print head 20. As illustrated in FIG. 1, the rotating means may include a drive motor 22 operably connected to the platen roller 14. In particular, the drive motor 22 in the embodiment illustrated is operably connected to a platen roller by several cooperating gears 24. The drive motor 22 may be any suitable motor known to those skilled in the art, such as a servo motor or a stepper motor.

Furthermore, the printing apparatus 10 of the present invention includes a pick 30, mounted downstream of the print head 20 and immediately adjacent the platen roller 14. The pick 30 strips or separates a leading edge portion of the adhesive backed label strip 12 from the platen roller 14 such that the label strip may be withdrawn from the printing apparatus 10 after indicia has been imprinted thereon, and in the manner further described below.

Figure 3:
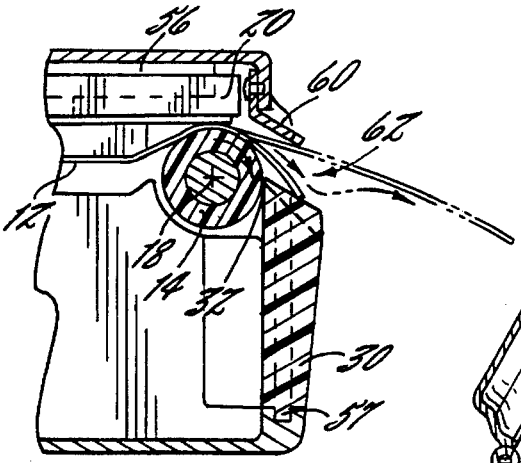
FIG. 3 is a fragmentary lateral cross-sectional view of the printing apparatus of the present invention illustrating in more detail the advancement of the label strip through the printing apparatus.

The pick 30 includes a first edge 32 which extends parallel to the axis of the platen roller 14. The first edge 32 is positioned immediately adjacent the peripheral surface of the platen roller 14 at a location downstream of the print head 20, and in the illustrated embodiment, the first edge 32 of the pick 30 contacts the peripheral surface of the platen roller 14 as shown in FIG. 3. However, the pick 30 and, in particular, the first edge 32 of the pick, need not physically contact the platen roller 14 but, instead, need only be positioned immediately adjacent the platen roller so as to effectively strip the leading edge portion of the label strip 12 from the platen roller.

The first edge 32 of the pick 30 is positioned downstream of the print head 20 to facilitate stripping of the label strip 12 from the platen roller 14. In particular, the print head 20 is biased against the label strip 12 and the underlying platen roller 14 as hereinafter discussed. Additional force may be exerted by the print head 20 on the label strip 12 and the underlying platen roller 14 during actuation of the print head to imprint indicia on the label strip. Accordingly, the adhesive backing of the label strip 12 is urged against the platen roller 14 and, depending upon the material forming the platen roller as hereinafter described, may adhere to the platen roller.

As best seen in FIG. 3, the first edge 32 of the pick 30 is preferably positioned about 90° about the arc of the peripheral surface of the platen roller from the print head, such that the label strip 12 may be readily stripped therefrom. However, the first edge 32 of the pick 30 may also be positioned at other angles about the arc of the peripheral surface of the platen roller 14, downstream of the print head, without departing from the spirit and scope of the present invention.

The pick 30 also preferably includes a pick surface 34 extending outwardly from the first edge 32 in the direction away from the platen roller 14. The pick surface 34 preferably extends outwardly from the first edge 32 at an angle between about 20° and 40° with respect to a radial line 36 of the platen roller 14 which passes through the first edge. It will be understood that the radial line 36 is shown in FIGS. 2 and 3 for purposes of illustration only and is not physically present in the printing apparatus 10 of the present invention. More preferably, the pick surface 34 extends outwardly at an angle of about 30° with respect to the radial line 36 of the platen roller 14 Which passes through the first edge 32. As further described below, once the leading edge of the adhesive backed label strip 12 engages the pick surface 34, the pick surface 34 exerts a lifting force on the leading edge portion of the label strip which acts to separate the label strip from the platen roller 14 as the platen roller continues to rotate.

Figure 5:
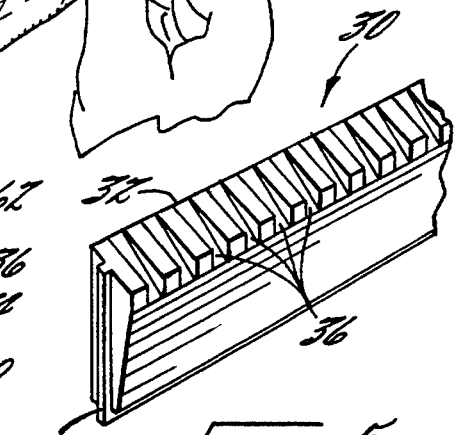
FIG. 5 is a fragmentary perspective view of a portion of the pick illustrating the plurality of grooves defined in the pick surface.

The pick surface 34 is generally planar. However, as illustrated in FIG. 5, one embodiment of the pick surface 34 defines a plurality of grooves 36 therein. The grooves 36 extend across the pick surface 34 in a direction away from the platen roller 14. Thus, the surface area of the pick surface 34 which contacts the advancing label strip 12 is reduced. Accordingly, frictional forces generated by the advancement of a label strip 12 across the pick surface 34 are reduced and the separation of the label strip from the platen roller 14 is facilitated.

In order to further facilitate the separation of the label strip 12 by the pick 30, the pick surface 34, and preferably the entire pick 30, is comprised of a plastic material, such as polytetrafluoroethylene commonly sold under the trademark "Teflon". Thus, the plastic pick 30 will not appreciably adhere to the adhesive backing of the label strip 12.

As described above, the pick 30 separates or strips the label strip 12 from the platen roller 14 even if the label strip has adhered to the platen roller 14 during the printing process. Thus, the platen roller 14 may be comprised of rubber material which may adhere to the adhesive backing of the labels 12. However, in some embodiments, the platen roller 14 is also comprised of a material, such as silicone, which does not appreciably adhere to the adhesive backing of the label strip 12. Thus, the separation of the label strip 12 from the platen roller 14 by the pick 30 is improved.

The printing apparatus 10 of the present invention, including the platen roller and the adjacent pick, may be either a stationary printer, which is typically relatively large, or a portable printer, which is readily carried by an operator. For illustrative purposes, however, a portable embodiment of the printing apparatus 10 of the present invention is shown and described in more detail hereinbelow.

Since an operator of a portable printing apparatus according to the present invention may readily carry the printing device in the field, the printing device generally includes a battery housing 38 adapted for receiving one or more batteries for supplying the requisite electrical power for printing and advancing the labels 12.

In the field, the operator of such a portable printing device typically enters data to be printed upon a label, such as via the keypad 40, and the printing apparatus 10 then prints an appropriate label 12. Thereafter, the operator may separate the label 12 and apply the label to the appropriate package or container. The information entered by the operator and imprinted on the label 12 may be stored by the printing apparatus 10 such that, upon returning to the office, the data may be subsequently downloaded, such as to a computer, to update or track inventory, for example. The data may be stored within any suitable memory device 42.

As shown, a portable printing apparatus 10 according to the present invention includes a protective case 44 in which the support frame 16, the holder 46, the platen roller 14, the printing means, the rotating means and the pick 30 are disposed. The protective case 44 is relatively small, such as, for example, 8 inches by 5 inches by 3 inches. Thus, the portable printing apparatus 10 may be carried by the operator, such as by a strap draped over the operator's shoulder and attached to the protective case 44 with clips 48.

Figure 4:
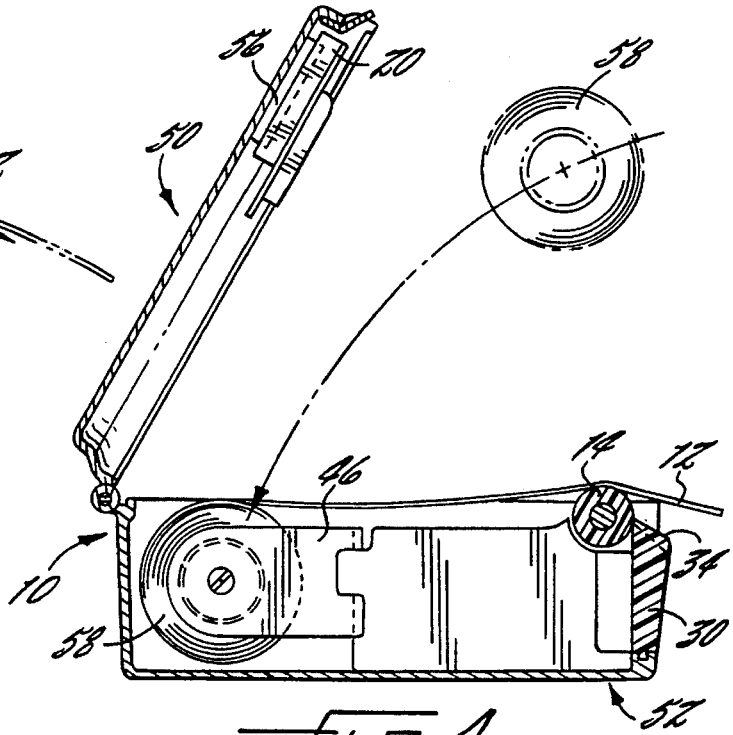
FIG. 4 is a lateral cross-sectional view of the printing apparatus of the present invention in an open position illustrating the loading of a wound roll of labels in the printing apparatus.

In one embodiment, the protective case 44 of the portable printing apparatus 10 of the present invention has a clam shell design. Accordingly, a lid portion 50 of the protective case 44 is hingedly connected to a base portion 52. The lid portion 50 may be raised or opened as illustrated in FIG. 4 during installation of a wound roll of labels 12 or closed as shown in FIG. 1 during printing. A pair of opposed latches 54 may be provided to secure the lid portion 50 in the closed position of FIG. 1.

Furthermore, the protective case 44 defines a slot 62 therein through which labels 12 which have been printed extend prior to separation by the operator. A tear bar 60, as further described below, is mounted along the upper edge of the slot 62, and the pick surface 34 defines the lower edge of the slot. The slot 62 preferably extends substantially parallel to the axis 18 of the platen roller 14. As illustrated in FIGS. 2–4, the base portion 52 may include a front wall 55 to which the pick 30 is mounted. In particular, the front wall 55 of the base portion 52 may include a groove defined about a portion of its periphery for receiving and mating with a tongue 31 extending outwardly from a corresponding portion of the periphery of the pick 30.

The drive motor 22, memory device 42, battery housing 38, holder 46 for rotatably mounting a wound roll of labels and print head 20 of the printing apparatus 10 of the invention may be identical to the corresponding components of a conventional portable printer. One example of such a conventional portable printer is Model No. PD 4220 U manufactured by Cognitive Solutions, Inc. Such conventional portable printers typically include a generally plastic weatherstrip plate mounted downstream of the platen roller in the position generally occupied by the pick 30 of the present invention, but such weatherstrip plate does not function to permit the printing of linerless label strips in the manner of the present invention.

For a printing apparatus adapted to perform direct thermal or thermal transfer printing, the printing apparatus 10 also preferably includes means for biasing the print head 20 against the underlying platen roller 14. The means for biasing the print head 20 maintains printing contact between the print head and the label strip 12 which is advanced between the print head and the platen roller 14.

In particular, the biasing means preferably includes one or more springs 56 positioned between the lid portion 50 of the protective case 44 and the print head 20. Accordingly, once the lid portion 50 is closed and latched, the springs 56 will urge the print head 20 against the label strip 12 and the underlying platen roller 14.

In one embodiment, the platen roller 14 includes an outer peripheral layer of resilient material to further enhance the print quality. Thus, the force exerted by the print head 20 against the label strip 12 and the underlying platen roller 14, such as by the biasing means, compresses a portion of the outer layer of the platen roller 14 to form a relatively flat printing surface on the portion of the platen roller 14 contacting the print head 20.

The printing apparatus 10 of the present invention is particularly adapted for printing indicia on labels 12. As illustrated in FIGS. 1 and 2, the labels 12 may be supplied in a wound roll 58. The wound roll 58 is preferably rotatably supported by a holder 46 which, in turn, is mounted to the support frame 16 of the printing apparatus 10.

As illustrated in FIG. 1, the printed labels 12 may be withdrawn from the printing apparatus 10 and separated from adjacent labels by the operator. In particular, the printing apparatus 10 preferably includes a tear bar 60 mounted downstream of the platen roller 14 and vertically above the surface 34 of the pick 30. The tear bar 60 includes a serrated edge against which the operator may pull the label strip 12. Thus, the label strip 12 may be cut so as to separate the printed label from the remainder of the label strip.

During installation of a wound roll 58 of labels, a leading edge portion of the wound roll is drawn from the wound roll and positioned across the platen roller 14 so as to extend outwardly from the platen roller as shown in FIGS. 2 and 4. As explained, the adhesive backing of the labels 12 directly contacts the underlying platen roller 14. Once the lid portion 50 of the protective case 44 is closed, the label strip 12 is held between the print head 20 and the platen roller 14. Thereafter, the print head 20 may be actuated to print indicia on the side of the label strip 12 opposite the adhesive backing. In order to advance or feed the label strip 12, the platen roller 14 is rotated and the label strip is fed between the platen roller and the print head 20. Due to the rotation of the platen roller 14 and the adherence, if any, of the adhesive label backing of the label strip 12 to the platen roller, the label strip generally rotates with the platen roller. As illustrated in FIG. 3, a leading edge of the label strip 12 is drawn downwardly from the outwardly extending position shown in dashed lines to a downsloping position.

Thereafter, the surface 34 of the pick 30 engages the leading edge of the label strip 12, and the surface 34 acts to lift the leading edge portion of the label strip and thereby release any appreciable adherence between the adhesive backing of the label strip and the platen roller resulting from the printing operation, and so as to cause the strip to be delivered in a tangential direction from the platen roller, note FIG. 3. Thus, the leading edge of the label strip 12 will extend outwardly through the slot 62 defined in the protective case 44. The printed label 12 may then be separated from the remainder of the wound roll 58 of the labels, such as by pulling the label strip against the serrated tear bar 60 as shown in FIG. 1. Once the printed label 12 has been separated, the leading edge portion of the label strip again generally extends tangentially outwardly from the platen roller 14 as illustrated in FIG. 2 and the printing process may be repeated.

As illustrated in FIG. 1, the label strip 12 typically consists of a primary substrate which has an adhesive backing on one side for attachment to an package or container once the predetermined indicia has been imprinted on the side of the label opposite the adhesive backing. Further, the label strip 12 is characterized in that, unlike conventional label strips, the label strips 12 which the printing apparatus 10 in the present invention is particularly adapted to process are not mounted upon a carrier web. Instead, the side of the label strip 12 opposite the adhesive backing is coated with a release agent, such as silicone. Accordingly, the adhesive will not adhere adjacent label strips together and the label strip 12 may be drawn from the wound roll 58.

In addition to printing label strips, the printing apparatus 10 of the present invention may also print other forms of media, including two-ply and multi-part forms. These forms may also be supplied in a wound roll and may be fed through the printing apparatus 10 such that indicia is imprinted thereon.

The information to be imprinted via the print head 20 may be provided to the printing apparatus 10 of the present invention according to any of the known methods. For example, the information to be imprinted may be provided via a data interface 64 from a source, such as a computer system or a remote alphanumeric keypad, to a system controller. The system controller is operably connected to the print head 20 and transmits signals thereto indicative of the particular indicia to be imprinted and the order and timing of the printing. Alternatively, the information or indicia to be imprinted upon the labels may be entered by the operator via an integral keypad 40 which is operably connected to the print head 20 for providing the control and timing signals necessary to print the desired information on the labels 12. Still further, other methods of providing the printing apparatus 10 with the predetermined information or indicia to be imprinted on the labels 12 are known to those skilled in the art and may be utilized.

The printing apparatus 10 may also include means for controlling the rotation of the platen roller 14 and the advancement of the label strip 12 between the print head 20 and the platen roller 14 such that the label strip 12 is only advanced once the individual labels which have already been fed between the print head and the platen roller have been separated from the remainder of the label strip. The controlling means therefore prevents a large number of printed labels from accumulating.

The controlling means may include any of the means known to those skilled in the art for controlling the advancement of a media through a printer. For example, the controlling means may include a detector, such as an optical sensor, that detects that the printed labels have been separated from the remainder of the label strip 12.

The printing apparatus 10 may also include means for controlling the registry or alignment of the label strip 12 with the print head 20. Thus, for label strips 12 which have been partially preprinted such as with the name of the delivery service, the desired indicia may be printed in the appropriate position relative to the preprinted material on the individual labels. As known to those skilled in the art, the alignment controlling means preferably includes means, such as one or more optical sensors, for detecting the position of the individual labels 12.

As described herein, an adhesive backed label strip 12 may be drawn from a wound roll 58 and fed between a platen roller 14 and a print head 20 such that indicia may be imprinted on one side of the label strip 12. A pick 30 thereafter strips or separates the printed labels 12 from the platen roller 14 such that the labels may be separated from the remainder of the label strip and applied to a package or container. Thus, the printing apparatus 10 of the present invention permits printing of label strips 12 which are not mounted upon a carrier web so as to decrease the media cost of the labels. Further, the printing apparatus 10 of the present invention readily separates the label strip 12 from the platen roller 14 after printing.

Although not illustrated, the pick 30 may comprise a member which is shaped in the manner of the numeral "7" in cross section, with the upper portion forming a bar which is positioned immediately downstream of the nip between the platen roller and print head and serving the function of the pick surface, and with the depending portion being mounted to the case 44. Also, the depending portion may be biased into contact with the periphery of the platen roller, so as to accurately position the upper portion with respect to the nip.

In the drawings and the specification, there has been set forth preferred embodiments of the invention, and although specific terms are employed, the terms are used in a generic and descriptive sense only and not for purposes of limitation, the scope of the invention being set forth in the following claims.

What is claimed is:

1. An apparatus for printing a linerless label strip backed with a tacky adhesive, the printing apparatus comprising:

a would roll of a linerless label strip, the label strip being backed with a tacky adhesive a support frame;

a holder mounted to said frame for rotatably supporting the wound roll of the label strip;

a platen roller rotatably mounted to said frame for supporting the label strip;

means for printing indicia on one side of the label strip and including a print head positioned in alignment with said platen roller such that the label strip is adapted to extend between said platen roller and said print head;

means for rotating said platen roller such that the label strip is thereby advanced between said platen roller and said print head; and a pick, mounted downstream of said print head and immediately adjacent said platen roller, for stripping a leading edge portion of the adhesive backed label strip from said platen roller such that the leading edge portion of the label strip, having indicia imprinted on one side thereof, may be withdrawn from the printing apparatus, wherein said pick has a first edge positioned immediately adjacent the peripheral surface of said platen roller at a location downstream of said print head, and wherein said pick includes a pick surface extending outwardly from said first edge in a direction away from said platen roller for directly contacting the tacky adhesive backing of the label strip and for providing a lifting force thereto to strip the leading edge portion of the adhesive backed label strip from the platen roller.

2. The printing apparatus as defined in claim 1 wherein said platen roller defines an axis extending therethrough, and wherein the first edge of said pick extends parallel to the axis of said platen roller.

3. The printing apparatus as defined in claim 2 wherein said first edge is positioned about 90° about the arc of the peripheral surface of said platen roller from said print head.

4. The printing apparatus as defined in claim 2 wherein said pick surface extends outwardly from said first edge at an angle of about 30° with respect to a radial line of said platen roller which passes through said first edge.

5. The printing apparatus as defined in claim 2 wherein said first edge contacts said platen roller.

6. The printing apparatus as defined in claim 2 wherein said pick surface defines therein a plurality of grooves extending in a direction away from said platen roller to thereby reduce the surface area of said pick surface which contacts the advancing label strip.

7. The printing apparatus as defined in claim 2 wherein said print head is mounted vertically above said platen roller and further comprising a tear bar mounted downstream of said print head and vertically above said pick surface for permitting individual labels to be separated from the label strip after indicia have been imprinted thereon.

8. The printing apparatus as defined in claim 1 wherein said pick is comprised of a plastic material which does not appreciably adhere to the adhesive backing of the label strip.

9. The printing apparatus as defined in claim 1 wherein said platen roller is comprised of a silicone material which does not appreciably adhere to the adhesive backing of the label strip.

10. The printing apparatus as defined in claim 1 wherein said platen roller includes an outer peripheral layer of resilient material such that the force exerted by said print head against said platen roller compresses a portion of the outer layer of said platen roller and forms a relatively flat printing surface on the portion of said platen roller contacting said print head.

11. The printing apparatus as defined in claim 1 further comprising a protective case in which said support frame, said holder, said platen roller, said printing means, said rotating means and said pick are disposed, said protective case defining therein a slot through which the label strip, having indicia imprinted on one side thereof, may be withdrawn, and having a relatively small size so as to be portable such that an operator of the printing apparatus may readily carry the printing apparatus.

12. The printing apparatus as defined in claim 11 wherein said protective case comprises a lid portion and hingedly connected base portion and is adapted to be opened to expose said holder such that the wound roll of labels may be mounted thereon.

13. An apparatus for printing a linerless label strip backed with a tacky adhesive, the apparatus comprising:

a wound roll of a linerless label strip, said label strip comprising a primary substrate, and a layer of tacky adhesive on one side of the primary substrate, and being characterized by the absence of a carrier web;

a support frame;

a holder mounted to said frame for rotatably supporting said wound roll of the label strip;

a cylindrical platen roller rotatably mounted to said frame for supporting the label strip, wherein said cylindrical platen roller has a generally smooth peripheral surface;

means for printing indicia on one side of the label strip and including a print head positioned in alignment with said platen roller such that the label strip extends between said platen roller and said print head;

means for rotating said platen roller such that the label strip is thereby advanced between said platen roller and said print head; and a pick, mounted downstream of said print head and immediately adjacent the peripheral surface of said platen roller, for directly contacting the tacky adhesive backing of a leading edge portion of the label strip and for providing a lifting force to the label strip to thereby strip the leading edge portion of the label strip from said platen roller such that the leading edge portion of the adhesive backed label strip, having indicia imprinted on one side thereof, may be withdrawn from the printing apparatus.

14. The printing apparatus as defined in claim 13 wherein the label strip further comprises a release layer on the side of the substrate opposite the layer of adhesive which does not appreciably adhere to the layer of adhesive so as to facilitate the unwinding of the label strip from said wound roll upon rotation of said platen roller.

15. The printing apparatus as defined in claim 13 wherein said platen roller defines an axis extending therethrough, and wherein said pick includes a first edge extending parallel to the axis of said platen roller and positioned immediately adjacent the peripheral surface of said platen roller at a location downstream of said print head, and a pick surface extending outwardly from said first edge in a direction away from said platen roller.

16. The printing apparatus as defined in claim 15 wherein said first edge is positioned about 90° about the arc of the peripheral surface of said platen roller from said print head.

17. The printing apparatus as defined in claim 15 wherein said pick surface extends outwardly from said first edge at an angle of about 30° with respect to a radial line of said platen roller which passes through said first edge.

18. The printing apparatus as defined in claim 15 wherein said first edge contacts said platen roller.

19. The printing apparatus as defined in claim 15 wherein said pick surface defines therein a plurality of grooves extending in a direction away from said platen roller to thereby reduce the surface area of said pick surface which contacts the advancing label strip.

20. The printing apparatus as defined in claim 15 further comprising a protective case in which said wound roll, said support frame, said holder, said platen roller, said printing means, said rotating means and said pick are disposed, said protective case defining therein a slot through which the label strip, having indicia imprinted on one side thereof, may be withdrawn, and having a relatively small size so as to be portable such that an operator of the printing apparatus may readily carry the printing apparatus.

21. The printing apparatus as defined in claim 20 wherein said slot includes an upper edge and a lower edge, and wherein said print head is mounted vertically above said platen roller, and further comprising a tear bar mounted downstream of said print head and along said upper edge of said slot for permitting individual labels to be separated from the label strip after indicia have been imprinted thereon.

22. The printing apparatus as defined in claim 21 wherein said pick surface defines said lower edge of said slot.

23. A method for printing a strip of labels comprising the steps of:

providing a wound roll of a linerless label strip, the label strip being backed with a tacky adhesive;

providing a printing apparatus having a cylindrical platen roller having a generally smooth peripheral surface, the printing apparatus also having a print head aligned with the platen roller and a pick mounted downstream of the print head and immediately adjacent the peripheral surface of the platen roller;

drawing the label strip from the wound roll to the platen roller such that the tacky adhesive backing of the label strip directly contacts the platen roller;

actuating the print head to print indicia on the side of the label strip opposite the adhesive backing;

rotating the platen roller such that the label strip is fed between the platen roller and the print head; and directly contacting the tacky adhesive backing of a leading edge portion of the label strip with the pick and lifting the leading edge portion of the label strip such that further rotation of the platen roller releases any significant adherence between the tacky adhesive backing of the label strip and the platen roller and so as to cause the strip to be delivered in a tangential direction from the platen roller.

24. The method as defined in claim 23 further comprising the subsequent step of separating a label on which indicia has been printed from the remainder of the label strip, such that the leading edge portion of the label strip remaining after a label has been separated therefrom extends in a tangential direction away from the platen roller and in a position to permit a repeating of the steps of the method to print another label.

25. The method as defined in claim 24 wherein the pick includes a first edge extending parallel to the axis of the platen roller and positioned immediately adjacent the peripheral surface of the platen roller at a location downstream of the print head, and a pick surface extending outwardly from the first edge in a direction away from the platen roller, and wherein the step of rotating the platen roller comprises the step of drawing the leading edge portion of the label strip which remains after a label has been separated and which extends in a tangential direction away from the platen roller toward the pick so that the leading edge of the leading edge portion engages the pick surface and so that any appreciable adherence between the adhesive backing of the label strip and the platen roller is thereby released.

* * * * *

UNITED STATES PATENT AND TRADEMARK OFFICE

CERTIFICATE OF CORRECTION

PATENT NO. : 5,497,701

DATED : March 12, 1996

INVENTOR(S) : David M. Uland

It is certified that error appears in the above-identified patent and that said Letters Patent is hereby corrected as shown below:

Item [56]

On the cover page, References, U.S. Patent Documents, Col. 2, please delete "Suzimoto et al." and insert therefore – Sugimoto et al. –.

On the cover page, References, U.S. Patent Documents, Col. 2, please delete "Petteriut et al." and insert – Petteruti et al. –.

Col. 2, line 48, after "permit", please insert – a –.

Col. 6, line 22, please delete "Which" and insert – which –.

Col. 8, line 65, please delete "an" and insert – a –.

Col 10, line 15, please delete "has" and insert – have –.

Col. 10, line 24, please delete "would" and insert – wound –.

UNITED STATES PATENT AND TRADEMARK OFFICE

CERTIFICATE OF CORRECTION

PATENT NO. : 5,491,701
DATED : March 12, 1996
INVENTOR(S) : David M. Uland

It is certified that error appears in the above-indentified patent and that said Letters Patent is hereby corrected as shown below:

Col. 10, line 35, after "adhesive", please insert --; --.

Signed and Sealed this

Fourteenth Day of January, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,497,701

DATED : March 12, 1996

INVENTOR(S) : David M. Uland

It is certified that error appears in the above-identified patent and that said Letters Patent is hereby corrected as shown below:

On the cover page, please delete "Notice: The portion of the term of this patent subsequent to Jan. 30, 2013, has been disclaimed."

On the cover page, delete [*], in item: [45].

Signed and Sealed this

Twentieth Day of May, 1997

*Attest:*

Bruce Lehman

BRUCE LEHMAN

*Attesting Officer*

*Commissioner of Patents and Trademarks*